United States Patent [19]

Gingher, Jr.

[11] 4,088,308

[45] May 9, 1978

[54] SYSTEM FOR CONTROLLING THE FLOW OF SINTER TO BLAST FURNACE

[75] Inventor: George C. Gingher, Jr., Dundalk, Md.

[73] Assignee: Bethlehem Steel Corporation, Bethlehem, Pa.

[21] Appl. No.: 742,141

[22] Filed: Nov. 15, 1976

[51] Int. Cl.[2] ..... F27B 21/02

[52] U.S. Cl. ..... 266/90; 222/55; 266/91

[58] Field of Search ..... 222/55, 56; 266/90, 266/91, 92

[56] References Cited

U.S. PATENT DOCUMENTS

| | | | |
|---|---|---|---|
| 3,275,431 | 9/1966 | Sawada | 266/92 X |
| 3,412,699 | 11/1968 | Culp et al. | 222/55 X |

FOREIGN PATENT DOCUMENTS

| | | | |
|---|---|---|---|
| 425,055 | 3/1975 | U.S.S.R. | 222/55 |

*Primary Examiner*—Roy Lake
*Assistant Examiner*—Paul A. Bell
*Attorney, Agent, or Firm*—Joseph J. O'Keefe; John I. Iverson; Robert M. Jones

[57] ABSTRACT

A dead band and a feed forward control are part of a closed loop system for converting the batch flow of sinter into an accumulating hopper into a steady flow of sinter out of this hopper.

4 Claims, 2 Drawing Figures

SOURCE OF ORE, COKE, ETC.
12
SINTER MACHINE
10
FEEDER SCREEN
16
14
FINES
CONVEYOR BELT 20
COOLER FEED HOPPER
18
COOLER
22
CONVEYOR BELT 23
24
COOLER DISCHARGE HOPPER
26
DISCHARGE FEEDER
28
CONVEYOR BELT 30
TO BLAST FURNACES

COOLER SPEED (FEED RATE)
46
DISCHARGE RATE
FEEDER DRIVE
42
MULTIPLIER
44
LEVEL CONTROLLER
40
ERROR
38
LEVEL SET POINT
36
Δ LEVEL
LOAD CELL
32
Δ WEIGHT
NON-LINEAR SIGNAL CONDITIONER
34
Δ LEVEL

SYSTEM FOR CONTROLLING THE FLOW OF SINTER TO BLAST FURNACE

BACKGROUND OF THE INVENTION

This invention relates to a closed loop control system. More particularly, it relates to such a system for controlling the flow of sinter out of an accumulating hopper.

In order to improve the operation of a blast furnace, fine ores, or fines, are screened from the ores to be supplied to the blast furnace. These fines are mixed with coke breeze, as well as small quantities of other materials well known in the art, and the resultant mixture is fed to a sintering machine where it is fused into larger size particles. This mixture is carried through the sintering machine on pallets, and the resultant coarser particles are subsequently dumped from these pellets, as discrete batches, onto a cooling conveyor, or cooler. After cooling, these batches of sinter are fed by conveyor belt to one of several blast furnaces.

It is desirable to feed a steady stream of sinter to a blast furnace. This, however, is complicated by several factors. As mentioned earlier, the sinter leaves both the sintering machine and the cooler in batches rather than as a continuous flow. In addition, the speed of the output from the sintering machine may increase or decrease temporarily due to the operating conditions of the sintering machine itself. As a further complicating factor, it is periodically necessary to stop the flow of sinter out of the sintering machine while the flow path of the sinter is changed from a conveyor belt leading to one blast furnace to another conveyor belt leading to another blast furnace.

In the past, a first accumulating hopper has been interposed between the feed means supplying the hot sinter to the cooler and the cooler itself. A second accumulating hopper has been interposed between the feed means supplying the cooled sinter to the conveyor belts leading to the blast furnace and the belts themselves. Both of these hoppers were provided with control systems that sensed the level of the material in the hopper. As the sensed level in a hopper varied from a preset reference level, an error signal was fed back to control the discharge feed rate from that hopper.

One problem that presented itself in this prior art system was that, as a result of the batch input into the system, an error signal was always present. This error signal oscillated about a reference level and prevented the control system from ever stabilizing.

It is an object of the present invention to provide a control system that maintains a fairly constant level in a hopper with a high degree of stabilization.

A second problem that presented itself in this prior art system was that relatively large error signals often occurred due to changes in the speed of the sinter machine, for example. No practical control system was available that functioned efficiently to control the hopper level despite both the relatively small changes due to the batch effect and also the relatively large changes due to speed changes in the sinter machine.

It is an object of the present invention to provide a control system that maintains a substantially constant level in an accumulating hopper despite both small and large changes in the rate of input of material into the accumulating hopper.

SUMMARY OF THE INVENTION

I have discovered that the foregoing objects can be obtained by providing control means for controlling feeder drive means that varies the rate of discharge of discharge feed means for moving materials away from the hopper. Means is provided for producing a first signal indicative of the actual level of the material in the hopper and a second signal indicative of the desired level of the material in the hopper. Further means is provided for combining this first and this second signal to provide an error signal. Means is interposed between the control means and the error signal-producing means for changing the rate of discharge of the discharge feed means only when the error signal exceeds a preset limit. Means is also interposed between the control means and the feeder drive means for changing the rate of discharge of the discharge feed means in response to a change in the speed of means feeding material into the hopper.

BRIEF DESCRIPTION OF THE INVENTION

DESCRIPTION OF THE PREFERRED EMBODIMENT

Figures 1, 2:
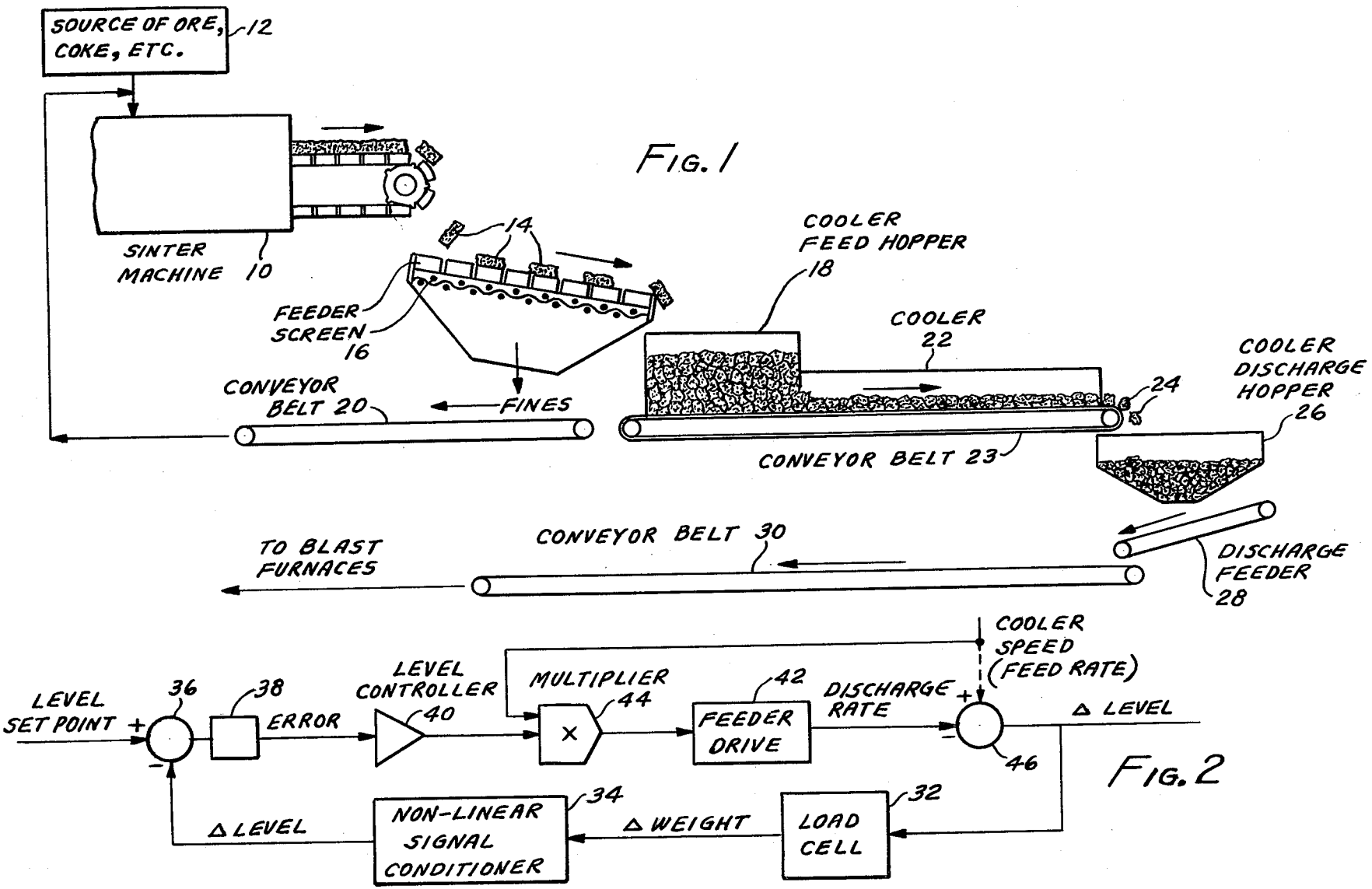
FIG. 1 is a flow sheet of a sinter supply system.
FIG. 2 is a block diagram of the control system of the invention.

As shown in FIG. 1, a sinter machine 10 receives material from a source 12 of ore, coke, etc., and fines that are screened out of the output from the sinter machine 10 and fed back to the input of the machine. The sinter is transported on pallets and leaves the machine 10 in discrete quantities 14. It is dumped onto a feeder-screen combination 16 that feeds the coarser particles to a cooler feed hopper 18 while simultaneously screening out fines. These fines drop to a conveyor belt 20 and are fed back to the input of the machine 10.

The rate of flow of material passing into the cooler feed hopper 18 varies for several reasons. First, the speed of the sinter machine 10 is variable and depends upon such factors as type of ore, size consist of ore, humidity, depth of material, rate of burn-through of the sinter, and the amount of fines being fed back into the input of the machine 10. Second, material may stick to the feeder screen 16 so that two batches of material may fall at the same time into the cooler feed hopper 18.

The sinter fed into the cooler feed hopper 18 empties into a cooler 22. The cooler 22 contains means, e.g., conveyor 23, for transporting the hot sinter on pallets from cooler feed hopper 18 along a path wherein it is cooled by forced air circulation. The amount of material leaving the cooler feed hopper 18 depends solely on the speed of the conveyor 23. The cooler sinter is dumped, in discrete quantities 24, into a cooler discharge hopper 26. The rate of feed from the hopper 26 is controlled by a discharge feeder 28, which may be a vibrating feeder. The feeder 28 supplies the sinter to one of a plurality of conveyor belts 30 that transport the sinter to several blast furnaces.

FIG. 2 is a block diagram of the control system of the invention. This system controls the rate at which material leaves an accumulating hopper and is applicable to both the cooler feed hopper 18 and the cooler discharge hopper 26. Inasmuch as the system is similar in principle, except for operating parameters, for both these hoppers, the system will be described only in connection with the cooler discharge hopper 26.

Means is provided for sensing the level of the material in the hopper. This means may be either direct, for example, a photocell system, or indirect, e.g., a load cell 32 that produces an output signal proportional to the weight of the hopper and its contents.

As shown in FIG. 1, the cooler discharge hopper 26 is so shaped that material level is not a linear function of the weight of the material in the hopper. Thus, the signal from the load cell 32 is passed through a nonlinear signal conditioner 34 that converts the signal from the load cell 32 into a signal proportional to the level of the material in the hopper 26.

The output from the signal conditioner 34 is fed to a setpoint 36 that has a reference level signal set into it. Thus, the output from the setpoint control 36 is a signal representing an error, viz., the difference between the reference level and the actual level in the hopper 26. This output signal is supplied to a dead band control 38. Control 38 produces no output signal unless the error signal from the setpoint control 36 exceeds a value equivalent to a level change of about 16%, by volume, of the capacity of the hopper from a reference level of about 50% of capacity. The 16% figure was selected because the batches of cooled sinter are each just slightly under 16% of hopper capacity.

The signal from the dead band control 38 is supplied to a level controller 40 that produces an output signal that controls the discharge feeder drive 42. However, the output from the level controller 40 first passes through a multiplier 44. A second signal, representative of the ratio of the speed of the cooler 22 to the speed of the discharge feeder 28 when the level of material in the hopper is constant and is at 50% of capacity, is multiplied by the signal from the level controller 40. The resultant signal is supplied to, and controls the speed of, the discharge feeder drive 42.

Symbol 46 represents a fictional adder-subtractor wherein any difference between the feed rate into the hopper 26 and the discharge rate out of the hopper 26 results in a change in the level of the material in the hopper 26 and a consequent change in the output signal from the load cell 32.

The subject system maintains a more stable mode of operation than the prior art in the following manner. Assume that the amount of material being fed into the hopper 26 does not equal the amount of material leaving the hopper 26, thereby resulting in a change in the level of material in the hopper 26. Should this change in the level of the material in the hopper 26 be sufficiently large that the error signal from the setpoint control 36 exceeds a limit of the dead band 38, the level controller 40 will change the speed of the discharge feeder drive 42 in a direction so as to bring the material level back toward a preset reference level.

As the discharge feeder drive 42 speed changes, a speed is reached that results in the amount of material being fed into the hopper equaling the amount of material leaving the hopper. However, in order to return the level of material in the hopper 26 to the reference level, this speed cannot be maintained. For example, if the hopper 26 is too full, the discharge feed rate must be increased beyond the equilibrium rate. This causes the hopper level to decrease until the reference level is reached. However, the hopper level continues to decrease because the discharge feeder drive 42 is being driven at a rate different from the equilibrium rate. Thus, a new level error signal is produced that would cause the speed of the discharge feeder drive 42 to change in the opposite direction were it not for the dead band 38. Because of the dead band 38, an error signal equal to about 16% of the capacity of the hopper 26 must be emitted by the setpoint control 36 before there is any change in the discharge feed drive speed due to a change in hopper level. In the absence of this dead band 28, the discharge feed drive speed would change continuously ad infinitum once a level error were introduced into the system.

As a result of the above-described feed forward control, large changes in level do not occur. For example, if the amount of material fed to the hopper is about to increase due to an increase in the speed of the cooler, an anticipating signal causes the hopper discharge feed rate to increase.

I claim:

1. In a system for converting a batch flow of material into a hopper into a steady flow of material out of said hopper, while maintaining a substantially constant level of material in said hopper, said system comprising means for emptying batches of material into said hopper at varying rates, discharge feed means for causing material to discharge from said hopper, and a feeder drive for varying the rate of discharge of said discharge feed means, the improvement comprising:

(a) control means for controlling said feeder drive,
(b) means for producing a first signal indicative of the actual level of the material in said hopper,
(c) means for producing a second signal indicative of the desired level of the material in said hopper,
(d) means for combining said first and second signals to obtain an error signal,
(e) means interposed between said control means and means (d) for permitting said control means to change the rate of discharge of said discharge feed means only when said error signal exceeds a preset limit, and
(f) means interposed between said feeder drive and said control means for changing the rate of discharge of said discharge feed means in response to a change in the speed of said means for emptying material into said hopper.

2. A system as recited in claim 1, in which:

(i) said material comprises iron ore sinter, and
(ii) said sinter is fed from said discharge feed means to a conveyor belt, and
(iii) said sinter is fed from said conveyor belt to a blast furnace.

3. In a system for converting iron ore to sinter, (a) a sinter machine receiving ore from a source and carrying said ore through said machine on pellets,
(b) a cooler feed hopper,
(c) a feeder screen receiving discrete batches of sinter from said sinter machine, screening the fines from said batches, and emptying the remainder of said batches into said cooler feed hopper, the rate of discharge of said feeder being variable,
(d) means for returning said fines to said sinter machine,
(e) a cooler receiving the sinter from said cooler feed hopper, including conveyor means for carrying said sinter away from said cooler feed hopper,
(f) drive means for varying the carrying-away rate of the conveyor means of said cooler,
(g) control means for controlling drive means (f),
(h) means for producing a first signal indicative of the actual level of sinter in said cooler feed hopper, (i) means for producing a second signal indicative of the desired level of sinter in said cooler feed hopper (j) means for combining said first and second signals to obtain an error signal, (k) means interposed between control means (g) and means (j) for permitting means (f) to vary the carrying-away rate of the conveyor means of said cooler only when said error signal exceeds a preset limit, and (l) means interposed between control means (g) and drive means (f) for changing the carrying-away rate of said conveyor means in response to a change in the rate at which said feeder screen empties sinter into said cooler feed hopper.

4. In a system for converting iron ore into sinter and supplying said sinter to a blast furnace, (a) a cooler for cooling hot sinter from a sintering machine, said cooler including conveyor means adapted to dump batches of sinter at a varying rate, (b) a cooler discharge hopper adapted to receive the sinter dumped by said cooler, (c) discharge feed means for causing sinter to discharge from said cooler discharge hopper, (d) a feeder drive for varying the rate at which sinter is discharged from said cooler, (e) control means for controlling said feeder drive, (f) means for producing a first signal indicative of the actual level of the sinter in said cooler discharge hopper, (g) means for producing a second signal indicative of the desired level of sinter in said cooler discharge hopper, (h) means for combining said first and second signals to produce an error signal, (i) means interposed between said control means and means (h) for permitting said control means to change the rate of discharge of said discharge feed means only when said error signal exceeds a preset limit, and (j) means interposed between said feeder drive and said control means for changing the rate of discharge of said discharge feed means in response to a change in the speed at which said cooler dumps sinter into said hopper.

* * * * *